US010357416B2

(12) United States Patent
Cole et al.

(10) Patent No.: US 10,357,416 B2
(45) Date of Patent: Jul. 23, 2019

(54) SURGICAL PATIENT POSITIONER APPARATUS, SYSTEM AND METHOD

(71) Applicant: Innovative Medical Products, Inc., Plainville, CT (US)

(72) Inventors: Earl Cole, Prospect, CT (US); Tim Blackwell, Jupiter, FL (US); Tamas Kovacs, Bristol, CT (US)

(73) Assignee: Innovative Medical Products, Inc., Plainville, CT (US)

( * ) Notice: Subject to any disclaimer, the term of this patent is extended or adjusted under 35 U.S.C. 154(b) by 538 days.

(21) Appl. No.: 15/058,137

(22) Filed: Mar. 1, 2016

(65) Prior Publication Data

US 2017/0252249 A1 Sep. 7, 2017

(51) Int. Cl.
*A61G 13/12* (2006.01)
*A61G 13/00* (2006.01)

(52) U.S. Cl.
CPC ..... *A61G 13/129* (2013.01); *A61G 13/124* (2013.01); *A61G 13/125* (2013.01); *A61G 13/1235* (2013.01); *A61G 13/1245* (2013.01); *A61G 13/1255* (2013.01); *A61G 13/0063* (2016.11)

(58) Field of Classification Search
CPC ..... A61G 13/1245; A61G 13/129
See application file for complete search history.

(56) References Cited

U.S. PATENT DOCUMENTS 4,615,516 A * 10/1986 Stulberg ..... A61G 13/12 5/650
5,462,551 A * 10/1995 Bailey ..... A61G 13/12 606/88
5,799,349 A * 9/1998 Petersen ..... A61G 13/0063 5/624
7,686,267 B2 * 3/2010 Dasilva ..... A61B 17/02 248/228.5
9,022,334 B1 * 5/2015 DeMayo ..... F16M 13/022 248/229.22
9,615,987 B2 * 4/2017 Worm ..... A61G 13/101
D816,848 S * 5/2018 Cole ..... D24/184
2005/0081865 A1 * 4/2005 Hubert ..... A61G 13/12 128/845

(Continued)

*Primary Examiner* — Eric J Kurilla
(74) *Attorney, Agent, or Firm* — Damian Wasserbauer, Esq.; Wasserbauer Law LLC

(57) ABSTRACT

A modular surgical patient positioner unit apparatus, system and method for adjustably positioning human joints such as knees for surgical operating procedures having a base plate to support moveably a transformable carriage that can be releasably locked in position and which adjustably supports a boot or other limb holder which can be releasably locked in position by the carriage. The base plate also is configured with a side bar located at a mid-portion of the base plate to secure to an arc clamp configured to secure the positioning system to a side rail of an operating table in a medical procedure on the left or right side of the body. An extension unit also is provided and configured to secure to a lower surface of the base plate to extend the base plate of the system, as needed, for larger limbs of patients, which extension unit is configured with a stud and post locking portions for securing to the base plate and for positioning in a medical procedure on either side of the body.

5 Claims, 16 Drawing Sheets

(56) References Cited

U.S. PATENT DOCUMENTS

| | | | | |
|---|---|---|---|---|
| 2005/0278851 | A1* | 12/2005 | DeMayo | A61G 13/10 5/624 |
| 2007/0251011 | A1* | 11/2007 | Matta | A61G 13/0036 5/624 |
| 2012/0085353 | A1* | 4/2012 | Siston | A61B 90/06 128/845 |
| 2014/0101851 | A1* | 4/2014 | Schuerch, Jr. | A61G 13/101 5/624 |
| 2015/0297302 | A1* | 10/2015 | Limoni | A61G 13/125 248/510 |
| 2016/0346150 | A1* | 12/2016 | Blackwell | A61G 13/129 |
| 2017/0165143 | A1* | 6/2017 | Schuerch, Jr. | A61G 13/125 |
| 2017/0296417 | A1* | 10/2017 | Schuerch, Jr. | A61G 13/101 |

* cited by examiner

SURGICAL PATIENT POSITIONER APPARATUS, SYSTEM AND METHOD

FIELD OF THE INVENTION

The present invention relates to knee positioning systems and, more particularly, to a modular patient positioning system configured with a clamp, base plate, and transformable carriage made universal to support moveably a transformable carriage on the base plate that can be releasably locked in position for a medical procedure on the left or right side of the body as well as a sterile extension for medical procedures on either side of the body using the clamp, transformable carriage, and base for a larger limb and/or patient.

BACKGROUND OF THE INVENTION

Conventional surgical patient positioners may be used for a medical procedures or surgical operations that require the joint or limb on the human body to be operated upon to be precisely and predictably positioned during such surgery including knees, knee replacement, fracture repair, as well as similar hand, foot, and ankle surgery. Optimum positioning requires a large range of positive positioning adjustments to be easily available so that the limb or joint to be treated is initially positioned and thereafter maintained in the desired position. Not only must such selected position be maintainable but also it is very important and often necessary that the limb be released and repositioned on demand during the course of the procedure to ensure optimum access thereby to require a variety of angular relationships for effective surgery.

However, conventional surgical positioners have disadvantages when trying to position patients having larger limbs, body parts and/or heavier, obese patients because these positioners may not attach beyond the side rail of an operating room table. In these instances, a separate extra-large positioning unit is utilized that as additional cost and expense. Accordingly, there is a need to provide a single, modular patient positioner unit with cost and space savings having facility for a medical procedure on the limbs on the left or right side of the body with only minor modification to the unit.

Moreover, surgical patient positioners are used by a facility repeatedly for ongoing medical procedures and require sterilization between such surgical operations. Conventional surgical patient positioning units, clamps and other assemblies have remote and/or inaccessible recesses and edges where human tissue and fluid may deposit that require additional time, costs and/or disassembly for effective sterilization. Accordingly, there is a need to provide a modular patient positioner unit with improved sterilization and reduced parts for use in medical procedures on the limbs of the left or right side of the body with only minor modification to the unit.

SUMMARY OF THE INVENTION

One purpose and object of the present invention is to provide a modular surgical patient positioner unit apparatus, system and method for adjustably positioning human joints such as knees for surgical operating procedures having a base plate to support moveably a transformable carriage that can be releasably locked in position and which adjustably supports a boot or other limb holder which can be releasably locked in position by the carriage.

Another purpose and object of the present invention is to provide a universal base plate configured with a side bar located at a mid-portion of the base plate to secure to an arc clamp configured to secure the positioning system to a side rail of an operating table in a medical procedure on the left or right side of the body.

Yet another purpose and object of the present invention is to provide an extension unit configured to secure to a lower surface of the base plate to extend the base plate of the system, as needed, for larger limbs of patients, which extension unit is configured with a stud and post locking portions for securing to the base plate and for positioning in a medical procedure on either side of the body.

Still yet another purpose and object of the present invention is to provide an arc clamp configured to secure to a side rail of the operating table for a medical procedure on the left or right side of the body and further configured to secure, in combination (1) the base plate of the modular surgical patient positioner unit to a side rail of an operating table; or (2) the extension unit of the modular surgical patient positioner unit to a side rail of an operating table, thereby using combination (1) or (2) as required for a medical procedure on the left or right side of the body.

It is yet another object of the present invention to provide an apparatus, system and method that may be sterilized and has a reduced number parts to sterilize so as to offer both cost and space savings effective to provide a single patient positioner unit that advantageously can be configured for medical procedures on the left or right side of the body with only minor modification.

It is a further object of this invention to provide surgical apparatus that is reliable safe, and durable in operation, easily maintained and sterilized, and easy for the surgeon to use during the actual medical procedure.

It is a still further object of the invention to provide apparatus which is easily adjustable by the surgeon or surgical assistant during the operation to obtain optimum positioning with minimum trauma to the patient.

It is still yet a further object of the invention to provide apparatus which can be fabricated from exceedingly durable materials with a structure that is easily used and totally sterilized for use under operating room conditions.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein.

DESCRIPTION OF THE EMBODIMENTS

Figure 1:
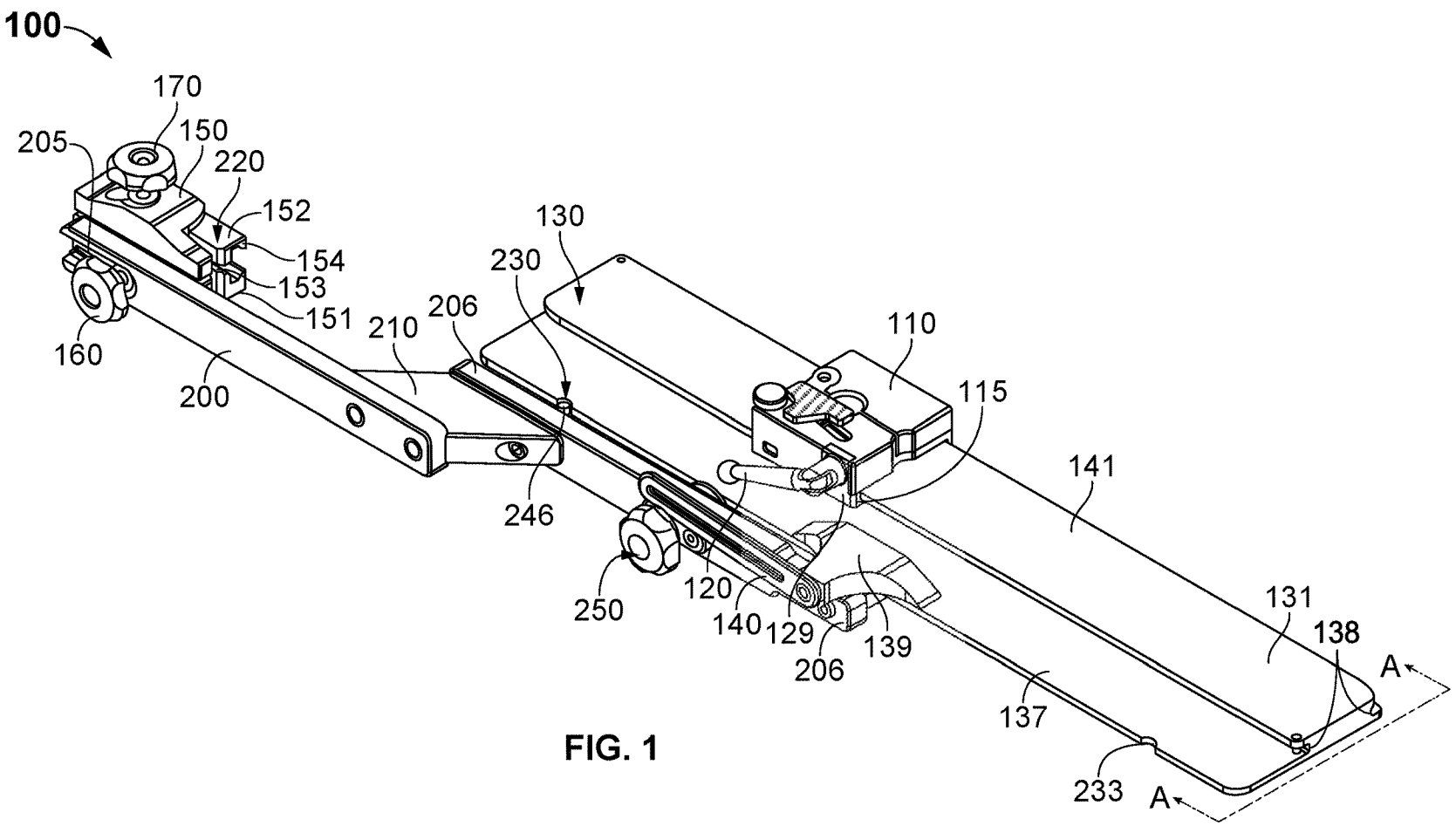
FIG. 1 is a schematic, perspective diagram illustrating the apparatus, system, and method for positioning in a medical procedure on the left or right side of the body in accordance with an embodiment of the present invention.
Figure 2:
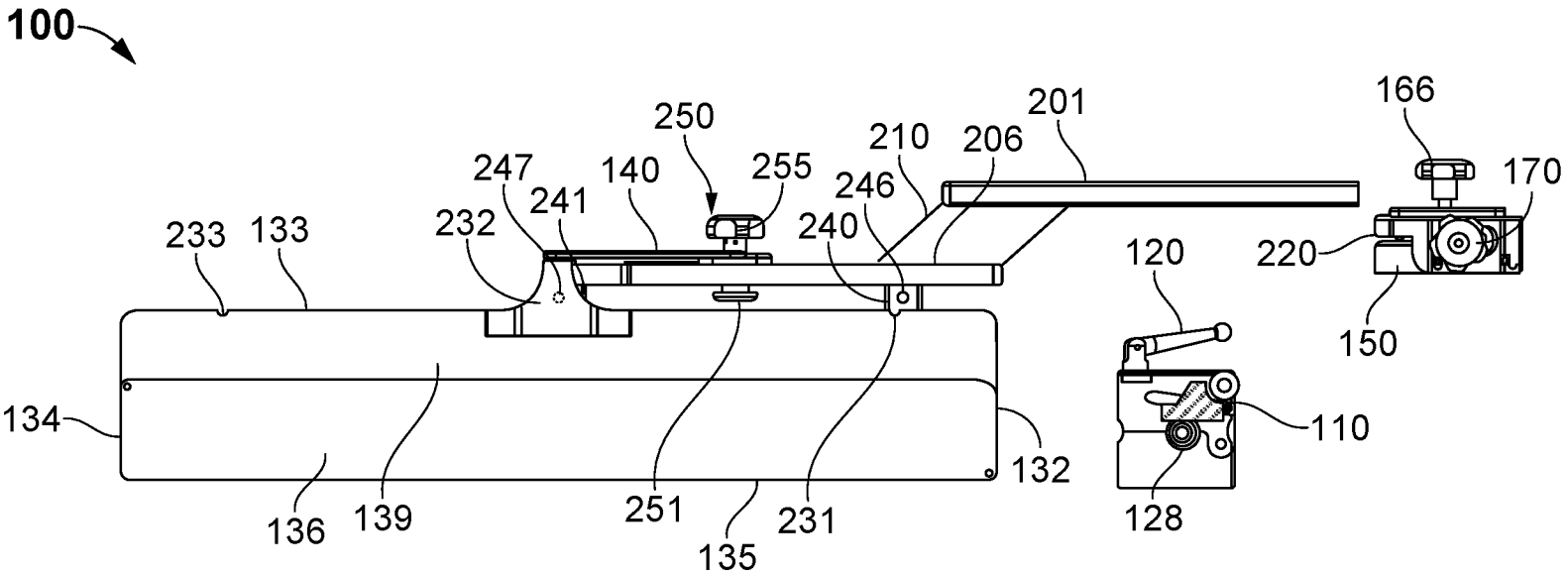
FIG. 2 is an expanded, top view illustrating a carriage, clamp, extension and base plate an assembly, system and method of the invention.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "bed" or "plate" refers to a generally planar structure with a small thickness compared to the planar dimensions. Useful materials for manufacturing the plate include surgical stainless steel or any grade of corrosion resistant steel that are used in biomedical applications such as, for example, the most common "surgical steels" are austenitic 316 stainless and martensitic 440 and 420 stainless steels.

As used herein the term "body" "body part" "extremity" or "limb" refers to a body part or extremity consisting of foot, ankle, knee, leg, hand, wrist, arm and shoulder of a patient.

As used herein the term "carriage" or "carriage unit" refers to a structure, rig or assembly configured to carry a holder of a body part in orthopedic surgery. The carriage unit is configured to hold, move and maintain a body part in a specific position as needed in orthopedic surgery.

As used herein the term "distal" refers to the end situated nearest to point of attachment or origin of the thing; and with reference to a body part or other anatomy situated farthest from point of attachment or origin, as of a limb or bone. As used herein the term "proximal" refers to the end situated nearest to point of attachment or origin of the thing; and with reference to a body part or other anatomy situated toward the point of origin or attachment, as of a limb or bone.

As used herein the term "holder" or "extremity holder" refers to a device or a means for supporting the body part, or joint thereof, of a patient in the preparation for surgery or medical activity and/or during surgery to hold a body part for access to the body part. A holder can be used to position the body part such as an arm or leg for patient preparation, for example, in knee surgery the holder is L-shaped to hold the foot and lower leg in any one of a number of positions and orientations relative to an operating table (not illustrated), which holds the remainder of the patient. In other embodiments, of the invention the holder may refer to, and should be understood to include, holders shaped to hold other body parts, such as an arm.

As used herein the term "patient" refers to any recipient of health care services. The patient is most often ill or injured and in need of treatment by a surgeon, physician, physician assistant, advanced practice registered nurse, veterinarian, or other health care provider.

As used herein the term "patient support" "operating table" "OR Table" refers to, and should be understood to include, a table, a bed, or any support structure upon which a patient may be disposed.

As used herein the term "support" refers to support for a skeletal joint, such as a knee, during surgery which support apparatus provides a virtually unlimited range of positional adjustments both before and during the surgery as well as for diagnostic motion range testing As used herein the terms "surgery", "operation" "surgical procedure" "surgical operation", or "medical procedure" refers to an activity directed at or performed on an individual (e.g. patient) intended to achieve a result in the care of the individual with an object of improving health, treating disease or injury, making a diagnosis; specifically the term "surgery", "surgical operation" refers an act of performing surgery and may be called a surgical procedure, operation, or simply surgery performed by a surgeon or other person in the performance of a medical procedure using operative and instrumental techniques on a patient to investigate and/or treat a pathological condition, disease, injury, to help improve bodily function, structure and/or appearance, or to repair unwanted broken joints, tissues, or ruptured areas on a patient to in the medical specialty context. The adjective surgical means pertaining to surgery; e.g. surgical instruments or surgical nurse. The patient or subject on which the surgery is performed can be a person or an animal. As used herein the term "medical activity" refers to the provision of medical care consisting of hospital activities, medical and dental practice activities, and "animal" or "other human health activities" by a surgeon, physician, physician assistant, advanced practice registered nurse, veterinarian, or other health care provider.

As used herein the term "track" refers to a metal structure forming a path that a carriage unit or other positioning device rides on, or moves along, as well as used to hold and maintain a body part in a specific position as needed in orthopedic surgery using the same positioner device.

As is illustrated in FIGS. 1-16, patient positioner unit, apparatus, system and method is generally shown as element 100, in according to an exemplary embodiment of the present invention, which advantageously is constructed in a modular system that may be used universally for numerous surgical patient positioner for performing a predetermined surgical or medical procedure 108. The apparatus and system 100 positioning a patient 101 arranged on a support or operating (OR) table 102 with a side rail 103, either integral or attached to the operating table 102, for positioning a body part or limb 104 for the surgical procedure in extremity holder 105. Generally, an extremity holder 105 of a predetermined shape is attached to a post 106 at a proximate end and a ball 107 formed or secured to the post 106 at a distal end useful for securing the extremity holder 105 to a transformable carriage assembly 110. As shown in FIGS. 1-7, 8A and 8B, the patient positioner 100 transformable carriage 110 that carries the holder 108 (i.e. a knee support flex boot) the pivot support of the post—106 and ball 107 disposed in the socket 128 that is fixed to the carriage 110 with its guide portion 115 carried by the up-standing track 138 on plate assembly 130, is one type of operating support device that can be used with the patient positioner apparatus and system 100 in accordance with the invention. Accordingly, the invention will be described in where the patient 101 has a knee positioned and held for surgery in the holder 105 positioned and held by carriage 110; however, it is to be understood that the positioner 100 is useful in generally securing and holding other body parts or limbs 104. When he doing up is it like to get my message The positioner apparatus and system 100 for a regular-sized patient 101 is configured with a clamp assembly 150 configured with a set clamp 160 and an arc lever clamp 170, a base plate assembly 130 configured to receive a transformable carriage assembly 110 configured with integral guide 115 to operably connect to a track 138 of the base plate assembly 130 for use in positioning a limb of a regular sized person, herein a first body size patient, for a medical procedure. The positioner apparatus and system 100 is configured to use an extension 170 for an oversized-sized patient herein defined as a patient of a second body size greater than the first body size, e.g. securing to the OR table 102 in the same plane 102*a* using the aforesaid clamp assembly 150, base plate assembly 120 configured to receive a transformable carriage assembly 110 operably connected to the holder 105 of a limb 104. Accordingly, the modular surgical patient positioner unit apparatus, system and method 100 in embodiment of the invention is utilized and described for adjustably positioning human joints such as knees for surgical operating procedures having a base plate to support moveably a transformable carriage that can be releasably locked in position and which adjustably supports a boot or other limb holder which can be releasably locked in position by the carriage. In this manner, the clamp assembly 150, base plate assembly 130, transformable carriage assembly 110 and extension mount 170 are used advantageously (1) for positioning a body part and/or limb of the left or right side of the body for a medical procedure of patient's; and (2) for positioning both first and second body sized patients. The apparatus, system and method 100 may be sterilized and has a reduced number parts to sterilize so as to offer both cost and space savings effective to provide a single patient positioner unit that advantageously can be configured for medical procedures on the left or right side of the body with only minor modification.

Referring to FIGS. 1-7, 8A, 9C, 13 and 16, a carriage assembly 110 for supporting the extremity holder 105 on the track 138 for selective movement of the carriage assembly 110 there along and with the plate assembly 130 secured to the support or operating table 102 typically by the side rail 103. The carriage assembly 110 and has a base 111 defining a rigid rectangular structure with a step 112, a hinge portion 113 located at one end of the step 112 for joining an arm 120 thereto and a recess portion 114 located along said step 112 configured to accept a protrusion 127 on arm 120, which construction is generally discussed in co-pending U.S. application Ser. No. 14/726,455 filed May 29, 2015, for "Knee Positioner with Expandable Carriage," which is hereby incorporated herein by reference in its entirety.

The base 111 further comprises a guide 115 configured to receive the track 138 of the plate assembly 130, as shown in FIGS. 1-7, 8B, 9C, 13 and 16. The base 111 has surfaces of an upper surface 116, lower surface 117 and side surfaces 118. The upper surface 116 is configured with the step 112 generally located and centered along a mid-line, the hinge portion 113 is located at one end of the step 112, and the recess 114 located at another end of the step 112. The track portion 115 is located on a lower surface 117 of the base 111. The base 111 has side surface(s) 118 so as to define a rigid rectangular structure, which is non-limiting as other designs are possible. The base 111 is intended for use in an operating room environment, and may be formed from suitable materials that are durable, sturdy, and that can be repeatedly sterilized such as, for example, most commonly formed from stainless steel that is known to reduce bacterial and early bio-film attachment, other suitable metals and metal alloys. The base 111 has an opening 119 in a side surface 118 configured to accept a lever assembly 190 configured with a threaded 191 rod 190 to operably connect to the arm 120 and tighten the carriage around the ball 107 of the holder 105 for positioning thereof of as is described herein.

Figure 5:
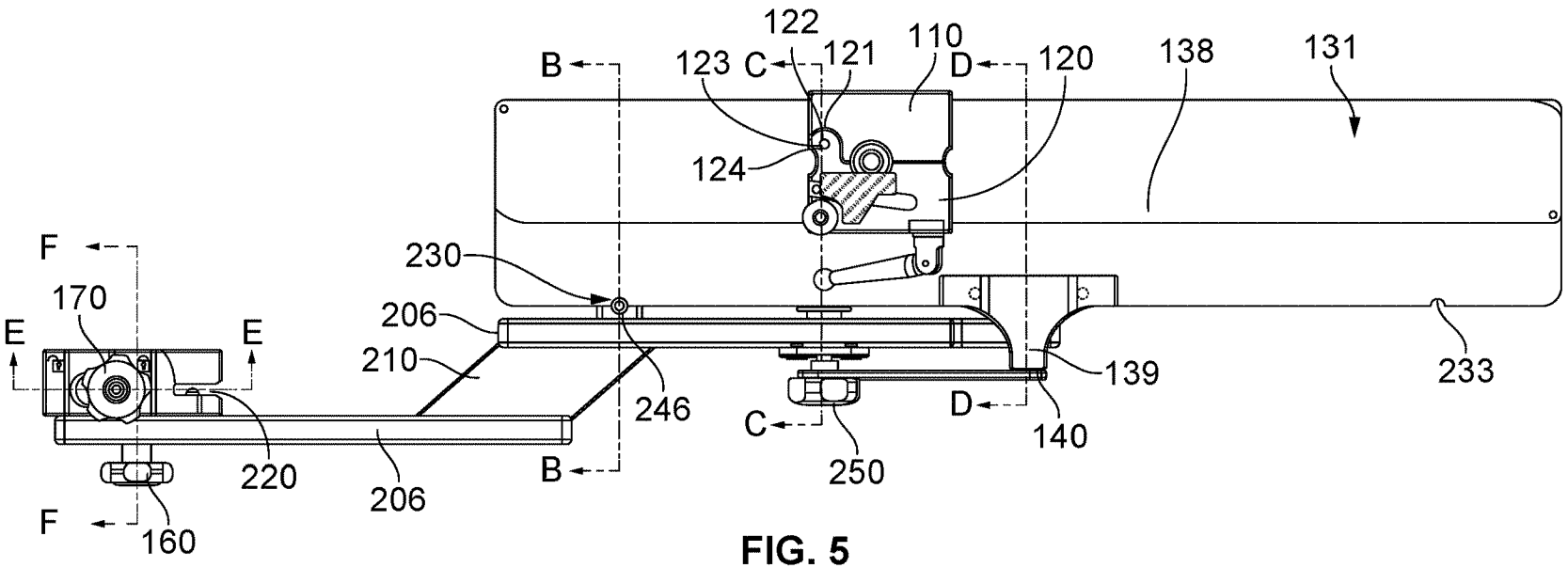
FIG. 5 is a top view illustrating a carriage, clamp, extension and base plate an assembly, system for positioning in a medical procedure on the left or right side of the body in accordance with an embodiment of the invention.
Figure 6:
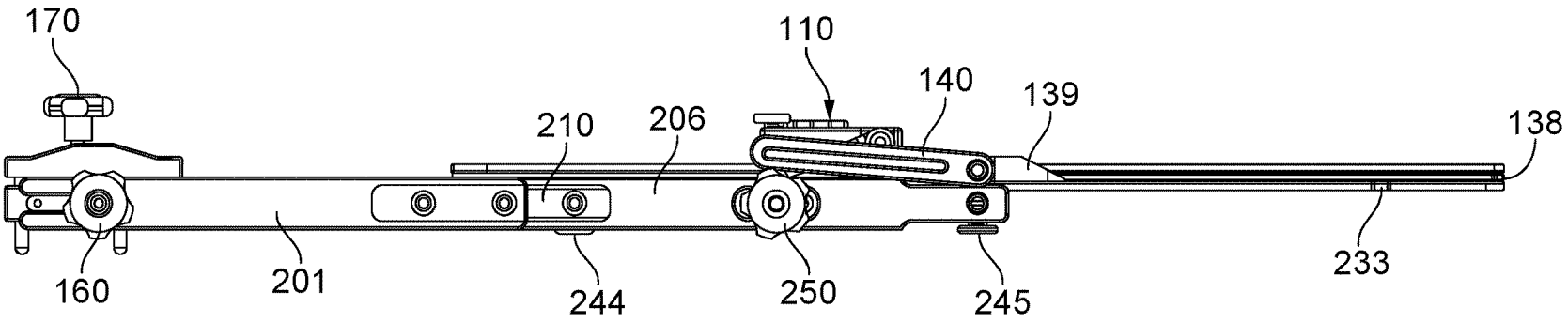
FIG. 6 is a side view illustrating a carriage secured to the base plate and the clamp secured to the extension of the positioning system of the invention.
Figure 7:
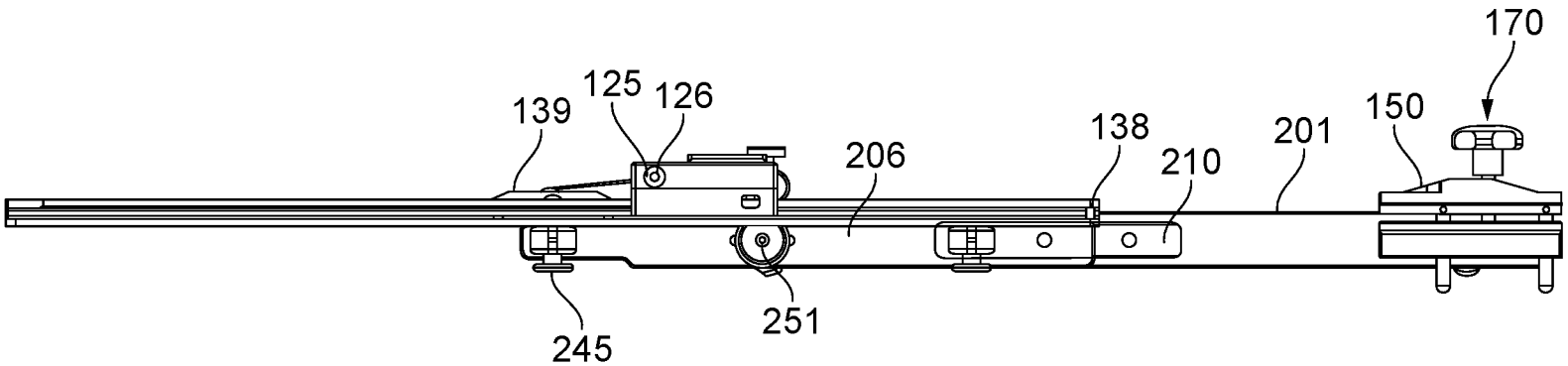
FIG. 7 is a side view illustrating a carriage secured to the base plate and the clamp secured to a side rail of an operating table the positioning system of the invention.
Figure 8A:
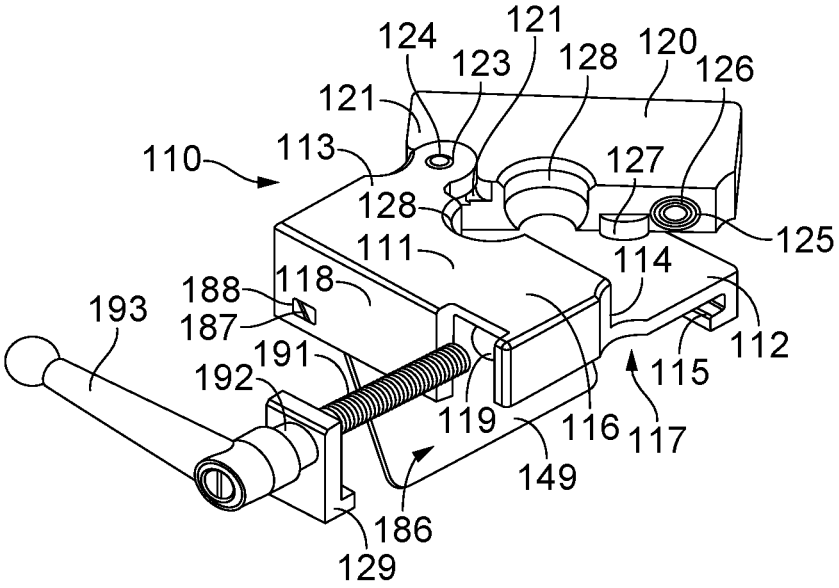
FIG. 8A is a perspective view illustrating the carriage of the invention.
Figure 8B:
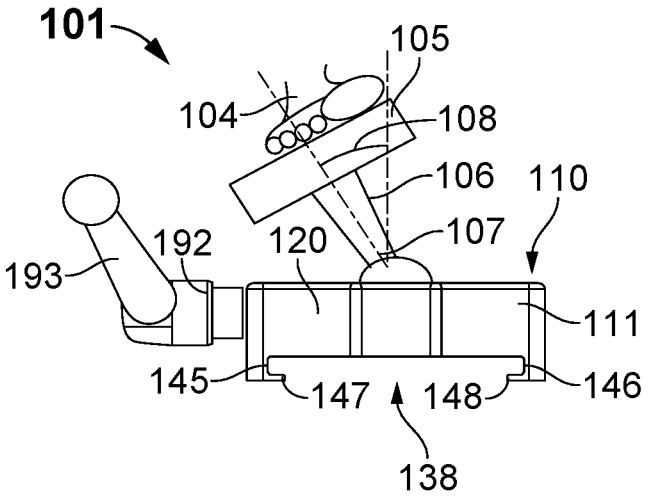
FIG. 8B is a perspective view illustrating the base plate, carriage and limb for positioning in a medical procedure.

As shown in FIGS. 5-7, the arm 120 further may be configured with a hinge portion 121 with a hole or opening 122 adapted to receive a pin 123 to join the arm 120 to the base 111, whereby the arm 120 has a dimension to fit to the base 111 adjacent the step 112 whereby the hinge portion 121 aligns with the hinge portion 112 on the base so as to be attached with pin 123, thereby opening and closing of the arm 120 by rotation around the pin 123 and hinge portions 113, 121. The hinge portions 113 and 121 can include a sleeve bearing 124 to provide smooth rotation around the point formed by the hinge portions and pin 123. The arm 120 can be a general rectangular shape and formed from a solid material. The arm 120 may be formed from suitable materials including surgical grade stainless steel yet other materials and/or metal alloys with qualities of durability, strength and that can be repeatedly sterilized to reduce bacterial attachment can be utilized. The arm 120 further may be configured with a hole 125 adapted to receive a threaded insert 126 to tighten the lever assembly 190 and perform the holding and securing to the track 138 and to the holder 105, as shown in FIGS. 1 and 7. The threaded insert 126 to prevent gauging of the solid material of the arm 193 by a threaded end 191 of the rod 192 upon clamping repeatedly, as shown in FIGS. 7, 8A, and 8B. The arm 120 is further configured with a protrusion 127 adapted to fit to the recess 114 in base 111 adjacent the step 112 by closing the arm 120.

As shown in FIGS. 1 through 16, the assembly 100 of the present invention is adapted to secure and to hold the extremity holder 105 in a desired position, thereby positioning a body part or limb 104 for a desired surgical procedure 108. The carriage 110 is configured with a socket 128 formed at a mid-point in the upper surface 116 adapted to receive a ball 107 or other attaching means of the extremity holder 105. The socket 128 is formed between the base 111 and arm 120 in the closed position. As the arm 120 abuts the step 112, the protrusion 127 is inserted in the recess along the step 112, thereby creating strength in the holding of the ball 107. The socket 128 can be tightened or loosed to open and close upon the ball 107 by the clamping action of the clamp assembly 110. For example, a tightening operation involves turning the handle 131 in a particular direction which pulls the arm 120 by engaging the threads of the threaded insert 126 in the hole 125 of the arm 120 with the threaded end 191 of rod 192. When joined the base 111 and arm 120 form a fulcrum at the hinge, the pin 123 and hinge portions 113, 121, thereby tightening the hold around the ball 107 in the socket 128. A loosening operation involves turning the handle 193 in a particular direction opposite tightening direction, thereby releasing the hold around the ball 107 in the socket 128 by the similar action of the threads pushing the arm 120 outwardly by the action of engaging the threads of the threaded end 191 and threaded insert 126.

Figure 9A:
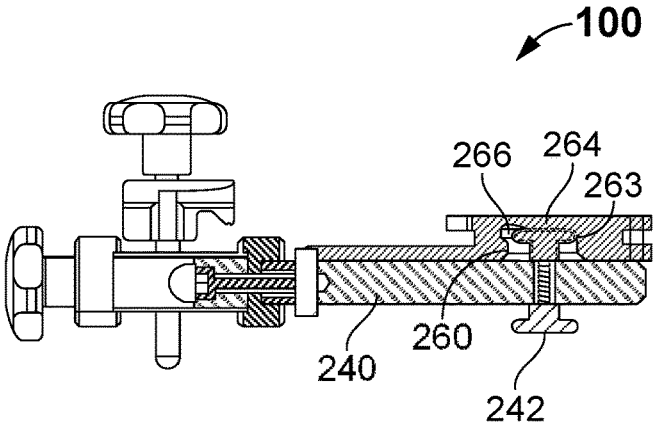
FIG. 9A is a cross-sectional view, taken along lines B-B of FIG. 5, illustrating a connection of the extension post and stud with the base plate of the invention.
Figure 9B:
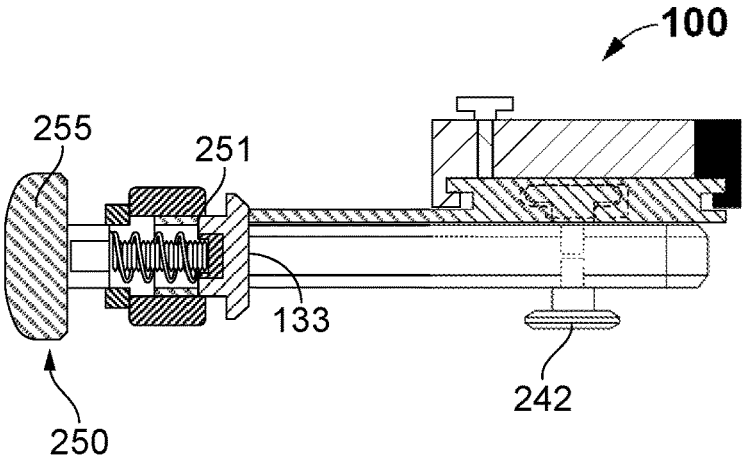
FIG. 9B is a cross-sectional view, taken along lines C-C of FIG. 5, illustrating a plate locking assembly on the extension post and to lock the post and studs integral to the mount assembly to the base plate of the invention.
Figure 9C:
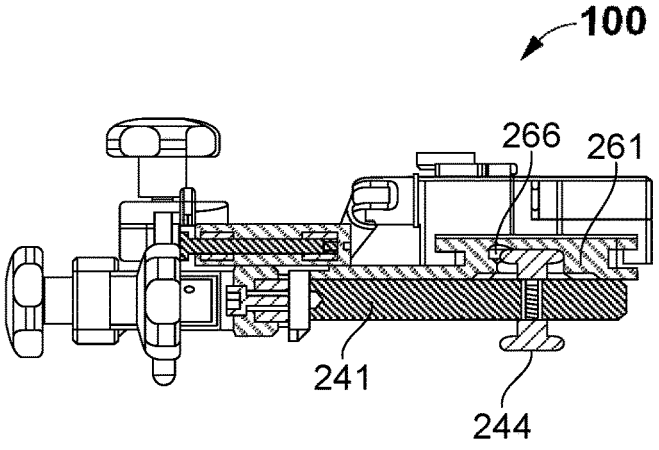
FIG. 9C is a cross-sectional view, taken along lines D-D of FIG. 5, a second connection to lock the post and studs integral to the extension unit to the base plate with the base plate of the invention.

According to an embodiment of the present invention, as shown in FIGS. 1-7, 16, and specifically FIGS. 8A, 8B, and 9C, a carriage assembly 110 is configured with a lever assembly 190 comprising a threaded 191 rod 192, a handle 193, and a track clamp tab 129. The treads 191 may be formed on at least a distal end of the rod 192 so as to releasably, operably connect with a treaded insert 126. The handle 193 may further include a swivel assembly 194 comprising a proximal end 195 of the rod 192 formed with a slot 196 configured to accept the tab end 197 secured by a post or other fastener 198 so as to form a pivot hinge 198. The swivel assembly 194 configured as a pivoting hinge advantageously provides improved one hand operation of the lever 194 for the simultaneous release and tightening of (1) the carriage assembly 110 to the track 138 and (2) positioning with the ball 107 of holder 105. For example, one hand operation is improved as the operator can tighten the lever assembly 190 having the handle 193 positioned substantially in an aligned position or common axis with the rod 192 and spinning to advance the treads through numerous rotations quickly, and then rotating the handle to the side, or crosswise, or in a position substantially transverse or perpendicular to the rod 192 to firmly tighten using the handle 193. In order to release, opposite actions may be performed whereby the operator grasps the handle in the side, or crosswise, or in a position substantially transverse or perpendicular to the rod 192 to release the firm connection, and then rotating the handle 193 to the substantially lateral, aligned position or common axis with the rod 192 and spinning to reverse the treads through numerous rotations thereby loosening the connection quickly. The handle 193 may be formed can be made from stainless steel and have an ergonomic design suitable to provide tightening and improved operation in a user's hands. The rod 192 can similarly be made from made from stainless steel. Each of the rod 192 and handle 193 are intended to be easily sterilized. The track clamp tab 129 is operatively connected using the lever assembly 190 to secure and hold the position of the carriage 110 the track 107 by a compression friction fit in the operation of tightening of the lever assembly 190.

As is illustrated in FIGS. 1-7, 8A-8B, 9C, 13, and 16, the lever assembly 190 operates in conjunction with the base 111 and the arm 120 as joined at the hinge (the pin 123 and hinge portions 113, 121) to form a fulcrum to tighten and loosen the hold around the ball 107 in the socket 128. A sliding plate 149 is located between a lower surface 117 of the base 111 and the track 138 for improving sliding movement and positioning of the carriage 110 along the track 107. The sliding plate 149 is formed of a predetermined friction reducing material including a polymer and other materials that can be sterilized. The sliding plate 149 has a generally planar surface 186 shape and tab(s) 187 at one edge configured for placement in tab holes 188 of the base 111. The sliding plate 149 is configured to pivot in a recess 144 in the lower surface 117 of the base 111 to a closed position when interposed between the base 111 and the track 138 for improving sliding movement and positioning of said carriage 110 along the track 138. The sliding plate 149 can open to an open position having the appearance of a flap useful for cleaning and sterilization as well as ease of maintenance and replacement of the sliding plate 149.

Figure 3:
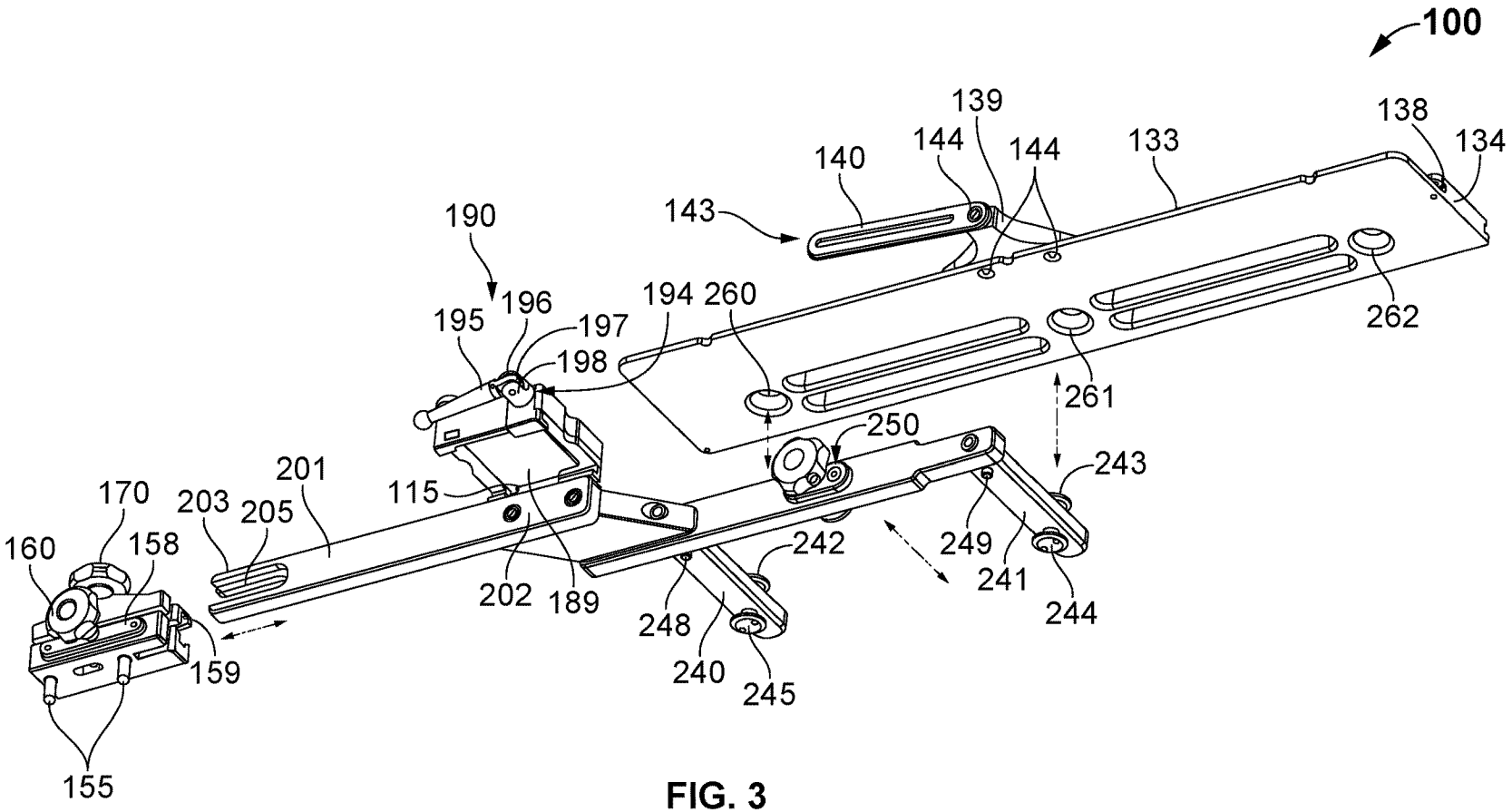
FIG. 3 is an expanded, bottom view illustrating an assembly, system and method of securing the extension to the base plate and the clamp to the extension of the invention.
Figure 4:
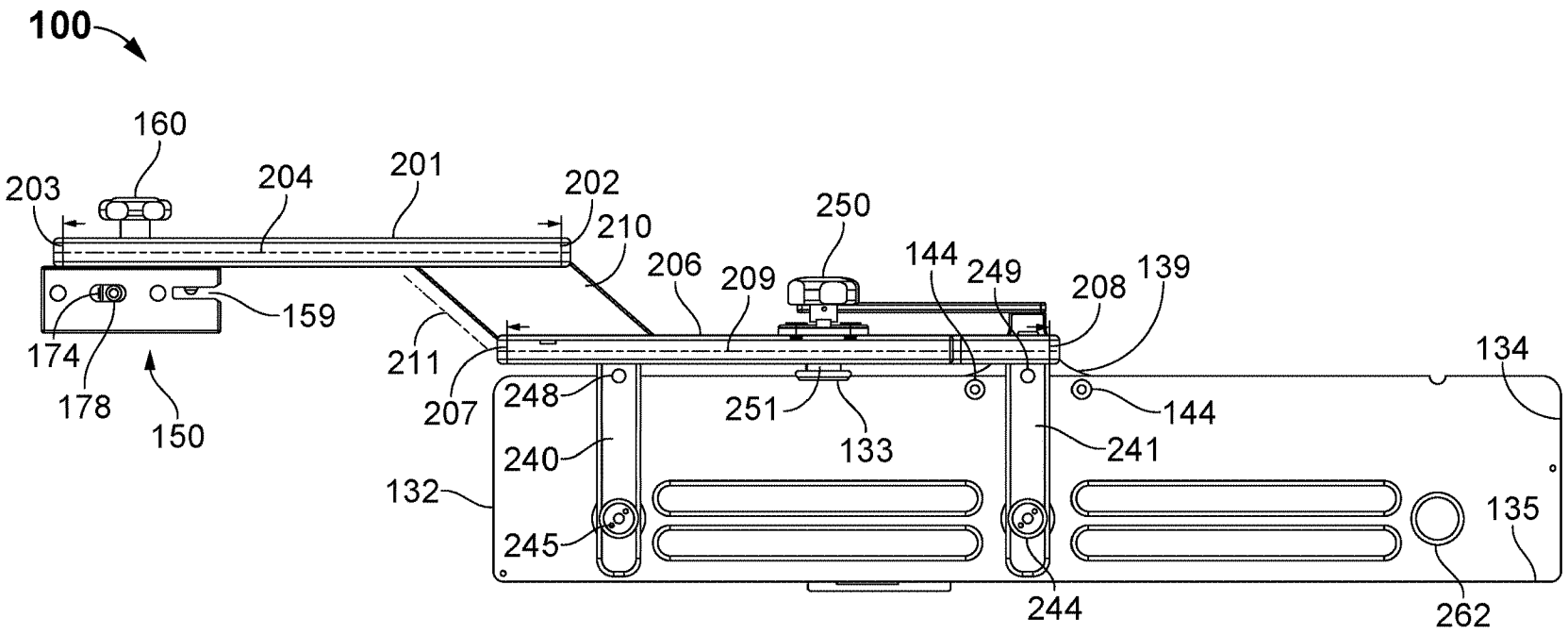
FIG. 4 is an schematic cross-sectional view, taken along lines A-A of FIG. 1, illustrating an assembly, system and method of securing the extension to the base plate and the clamp to the extension of the invention.
Figure 13:
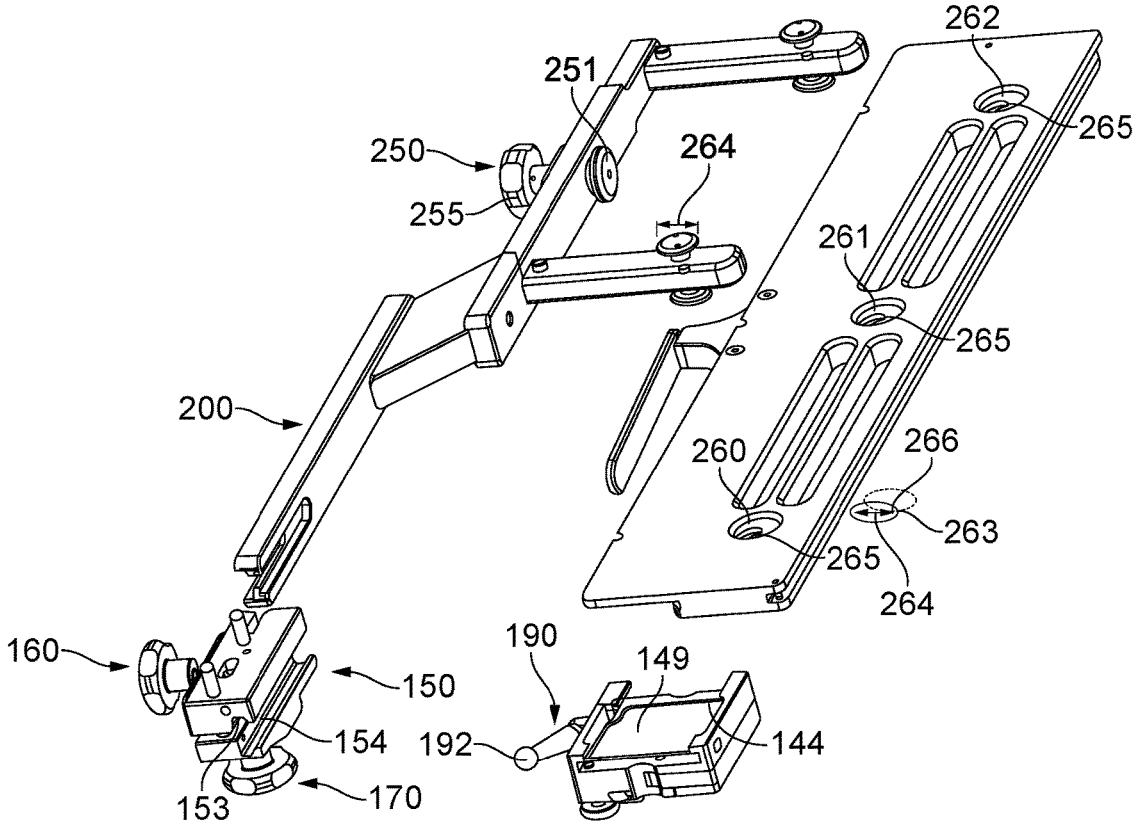
FIG. 13 is an expanded, perspective bottom view illustrating the carriage of the positioning system and the base plate for securing to an extension and secured to a side rail of an operating table by the clamp of the invention.
Figure 14:
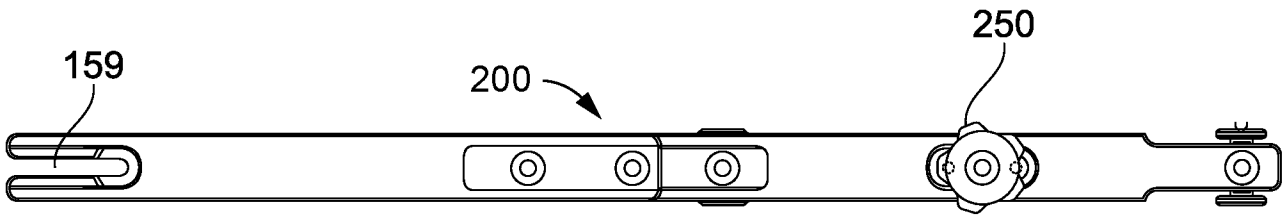
FIG. 14 is a side view illustrating a sterile extension to operating table of the invention for use in positioning the left or right side of the body for a medical procedure.
Figure 15:
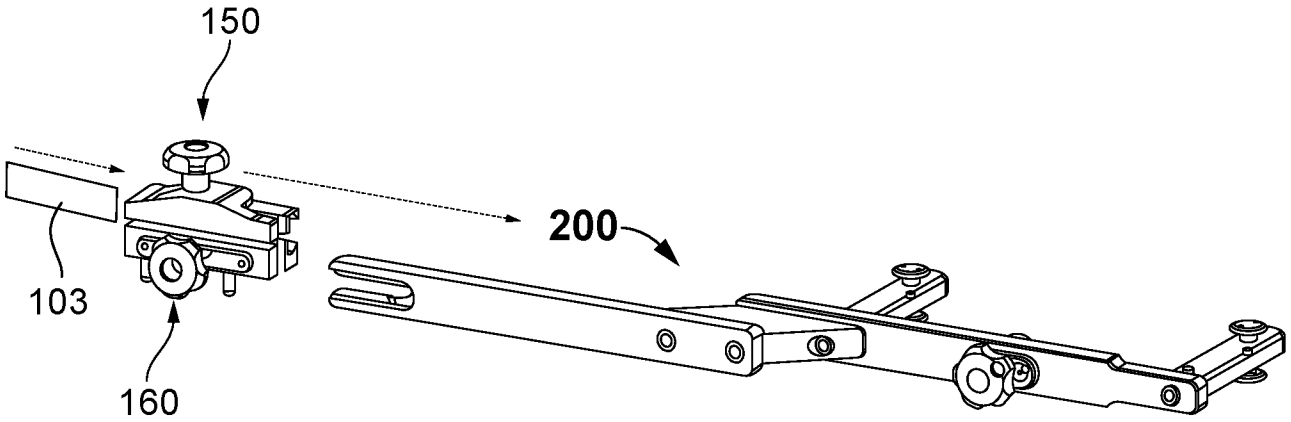
FIG. 15 is a perspective, side view illustrating a clamp connection to the rail of an operating table and a sterile table extension of the invention.

Referring to FIGS. FIGS. 1-7, 8B, 13, 15, and 16 the track 138 of the plate assembly 130 is configured with a bed 131 formed generally from a flat rectangular plate, which is generally shown in co-pending U.S. application Ser. No. 14/726,601 filed Jun. 1, 2015 "Expandable Base Plate For Knee Positioner," which is hereby incorporated herein by reference in its entirety. The bed 131 has opposite parallel end edges 132, 134 and lateral edges 133, 135 perpendicular to end edges 132, 134. Because the bed 131 is intended for use in an operating room environment, it is formed from materials that are durable, sturdy, and that can be repeatedly sterilized such as, for example, most commonly formed from surgical stainless steel that is known to reduce bacterial and early bio-film attachment, other suitable metals and metal alloys. The bed 131 has lateral edges 133, 135 perpendicular to end edges 132, 134. The bed 131 has a bottom surface 136, for example, as shown in FIGS. 3, 4, and 13. The bed 131 has a top surface 137 configured with a track 138. The bed 131 may be configured with a mid-portion 139 adjacent one of one of the lateral edges 133, 135.

Figure 16:
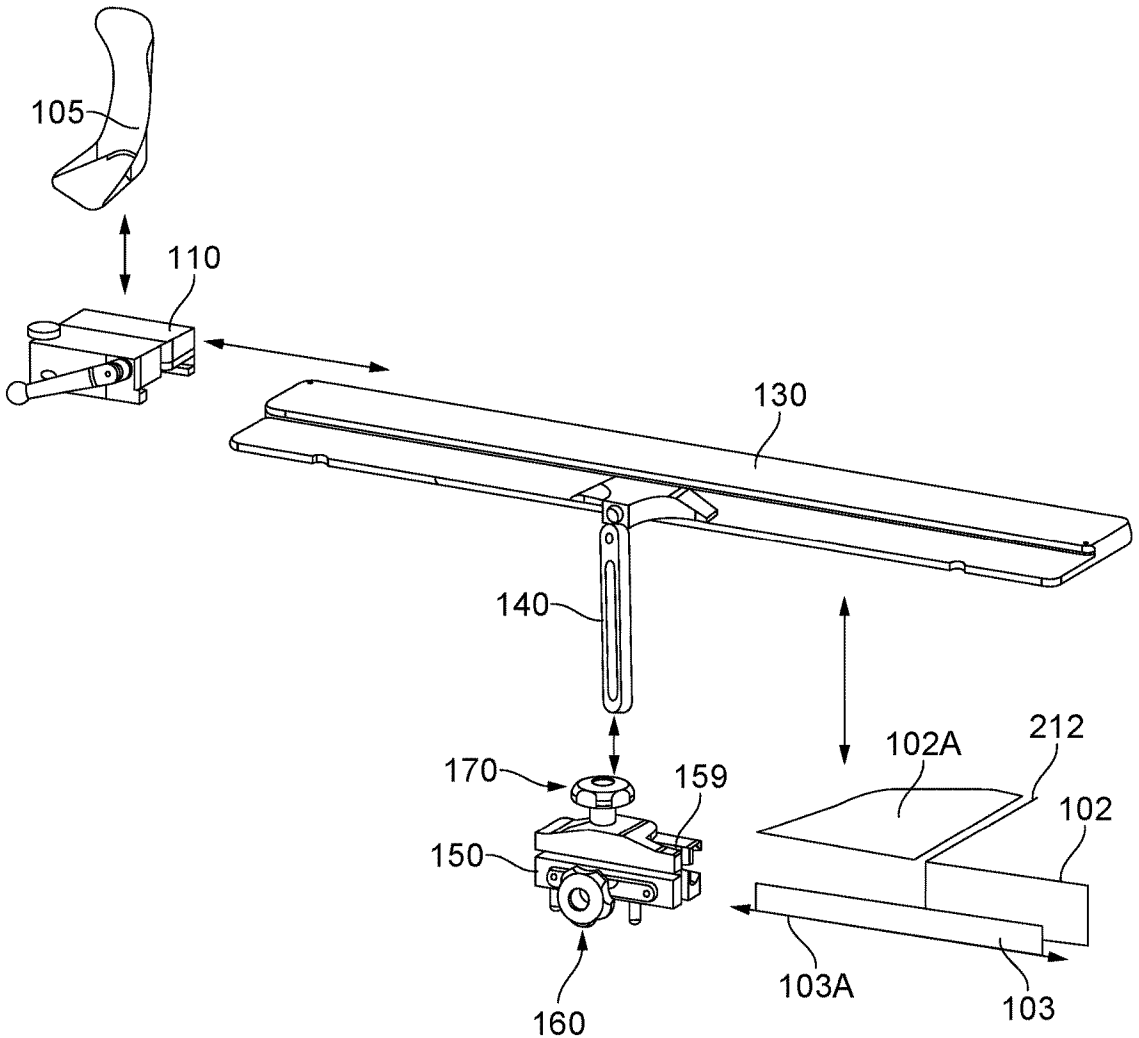
FIG. 16 is a perspective, side view illustrating a clamp connection to the rail of an operating table and a sterile table extension of the invention.

The bed 131 may be configured with a bar or transverse arm 140 affixed at the mid-portion 139 of the bed 131 on a selected one of the lateral edges 133, 135, for example, bar 140 is secured to lateral edge 135, which can be used to secure the plate assembly 110 to an operating table 102 (FIG. 16). The bar 140 is disposed at an angle perpendicular to the flat bottom surface 136 of the bed 131. The bar 140 may be configured to be adjustable in length and to rotate for storage or when using the plate assembly 130 with the mount assembly 200 as discussed herein or when storing on a flat surface. Adjustability is provided according to an embodiment of the invention, by the bar 140 having an elongated planar shape 141 with an arm channel 142, formed by material removed from a central portion 143 secured to the mid-portion 139 by a fastener 144, whereby the bar 131 is movable about the fastener to rotate to position the arm channel 142 in the arm slot 159 or out of the way if the mount assembly 200 is used.

Referring to FIGS. 1 and 8B, in the illustrated embodiment of the present invention, the track 138 is configured to be received by a carriage 110 of a holder 105 of a limb 104 for positioning. The track may be formed comprising shoulders 145, 146 rising vertical from the bed 131 connecting to flange edges 147, 148 extending over the shoulders 145, 146 so as to create an recess of the track 138 extending laterally along the bed 131, whereby the flange edges 147, 148 of the track 138 slidably connect to the guide 115 of the carriage 110 thereto. The upper surface 149 of the track 138 may be formed smooth and parallel to the top surface 137 for connecting slidably the carriage 110 thereon. The track 138 may be formed in a bed 131 from a solid material such as metal, aluminum, stainless steel, surgical steel, and/or metal alloys, and can be manufactured using automated computer numeric control (CNC) milling and other manufacturing techniques.

Referring to FIGS. 1-7, 13, and 16 the base plate assembly 130 is configured with one or more extension mount holes or openings 260, 261 formed in the base plate bottom surface 136 thereof. Each of the more extension mount holes or openings 260, 261 may be configured in a predetermined diameter 263 and depth 264, and an offset hole radius 265 of a predetermined smaller diameter 266 formed each extension mount openings 260, 261 and 262. The predetermined diameter 263 of the extension mount openings 260, 261 and 262 is a diameter selected to receive freely a diameter dimension of the studs to 242-245, e.g. insert the mushroom-cap shape of the studs 242. The predetermined smaller diameter 266 of the offset hole radius 265 formed in the extension mount openings 260, 261, 262 is a diameter selected to match a diameter dimension of the studs to 242-245, e.g. to grab and hold the mushroom-cap shape of the studs 242-245 when the plate locking assembly 250 pushes against the lateral edge 135 of the bed 131 as is discussed in further detail with respect to the mount assembly 200 herein. Each of the more extension mount holes or openings 260, 261, 262 is formed and the bed 131 of the base plate assembly 130 disposed within the portion of material under the track 138. The predetermined diameter depth 264 of each extension mount openings 260, 261, 262 is of a suitable depth for the bed 131 to contact the support beam 240, 241 to grab and hold the mushroom-cap shape of the studs 242-245, and is less than the thickness measured from the bottom surface 136 to the flat planar surface 141 of the track 138, e.g. so as not to exit into the track 131 flat planar surface. 141. The extension mount holes or openings 260, 261 and an offset hole radius 265 therein can be manufactured using automated computer numeric control (CNC) milling and other manufacturing techniques.

Referring to FIGS. 1-7, 10-12, 13, 15, and 16, in the illustrated embodiment of the present invention, a clamp assembly 150 is configured advantageously with a set clamp assembly 160 and an arc lever clamp assembly 170. The set clamp assembly 160 is configured to secure the bar or transverse arm 140 of the plate assembly 130 to the rail 103 of the support or operating table 102 using a set clamp 160. The arc lever clamp 170 is configured to secure and adjust position of the plate assembly 130 to the rail 103 of the support or operating table 102 using the arc lever clamp 170, e.g. the surgical knee positioner assembly and system 100 per se.

Referring to FIGS. 1, 10-12, the clamp assembly 150 is configured with a base clamp 151 and a top clamp 152 each configured with jaws 154 and 155, respectively, to secure and adjust position of the plate assembly 130 to the rail 103 of the support or operating table 102. The base clamp 151 and top clamp 152 may be formed from a solid material such as metal, aluminum, stainless steel, and/or metal alloys, surgical stainless steel or any grade of corrosion resistant steel that are used in biomedical applications. The base clamp 151 and top clamp 152 can be manufactured using automated computer numeric control (CNC) milling and other manufacturing techniques. The set clamp assembly 160 that may be formed in the base clamp 151, generally, and it should be appreciated that the arm slot 159 also is formed in the base and top clamps 151, 152 and is functionally operates using the base clamp 151 to secure the arm 120 within the slot 159 against the side rail 103. The arc lever clamp 170 may be formed in the base clamp 151 and top clamp 152, e.g. the arc lever 170 is assembled to the base clamp 151 for controlling the position of the jaws 154 and 155 in the manner to be described below in greater detail. A pair of upstanding guideposts 155 may be secured in guide post holes 156 formed in the top clamp 152 and set in place with set screws and the guide posts are received in a corresponding pair of guide apertures 157 formed in the base clamp 151 for aligning, supporting the top clamp 152 upon the base clamp 151 in clearance relation. The clamp assembly 150 may further have an arm slot 159 formed in an end of the base and top clamps 151, 152, respectively, to receive operably the arm 120 of the plate assembly 130.

Referring to FIGS. 1, 10-12, the clamp assembly 150 is configured with a base clamp 151 and a top clamp 152 each configured with jaws 153 and 154, respectively, to secure and adjust position of the plate assembly 130 to the rail 103 of the support or operating table 102. The base clamp 151 and top clamp 152 may be formed from a solid material such as metal, aluminum, stainless steel, and/or metal alloys, surgical stainless steel or any grade of corrosion resistant steel that are used in biomedical applications. The base clamp 151 and top clamp 152 can be manufactured using automated computer numeric control (CNC) milling and other manufacturing techniques. The set clamp assembly 160 that may be formed in the base clamp 151, generally, and it should be appreciated that the arm slot 159 also is formed in the base and top clamps 151, 152 and is functionally operates using the base clamp 151 to secure the arm 120 within the slot 159 against the side rail 103. The arc lever clamp 170 may be formed in the base clamp 151 and top clamp 152, e.g. the arc lever 170 is assembled to the base clamp 151 for controlling the position of the jaws 153 and 154 in the manner to be described below in greater detail. A pair of upstanding guideposts 155 may be secured in guide post holes 156 formed in the top clamp 152 and set in place with set screws and the guide posts are received in a corresponding pair of guide apertures 157 formed in the base clamp 151 for aligning, supporting the top clamp 152 upon the base clamp 151 in clearance relation. The clamp assembly 150 may further have an arm slot 159 formed in an end of the base and top clamps 151, 152, respectively, to receive operably the arm 120 of the plate assembly 130.

Figure 10:
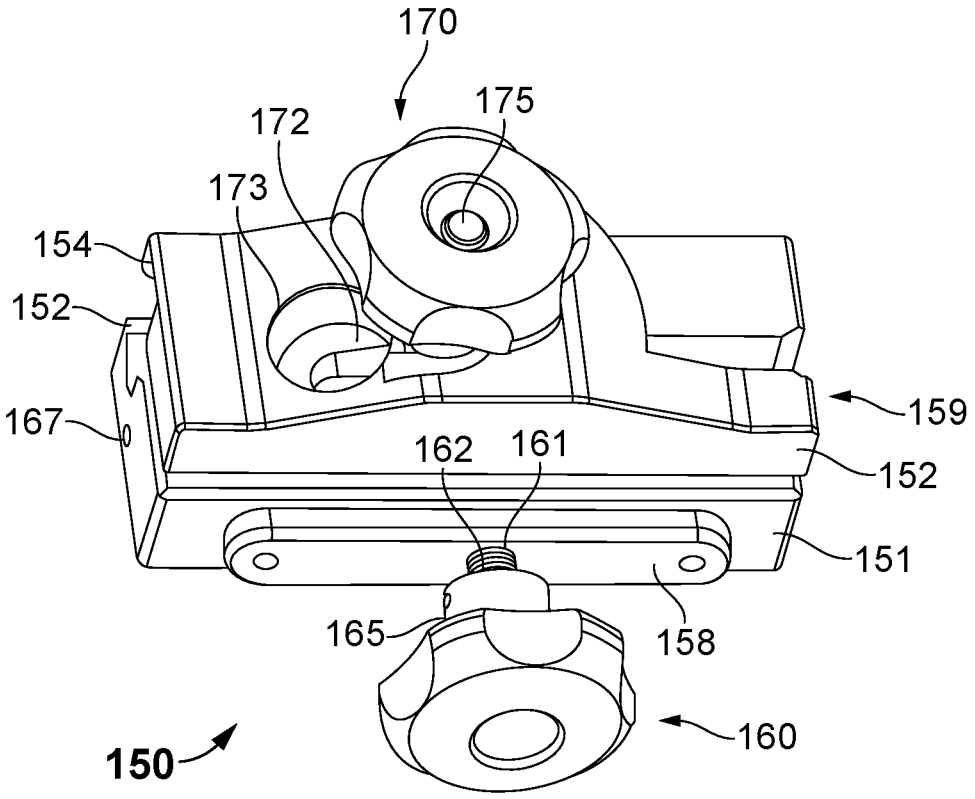
FIG. 10 is a perspective top view illustrating a combined extension clamp and operating table rail clamp of the invention.
Figure 11A:
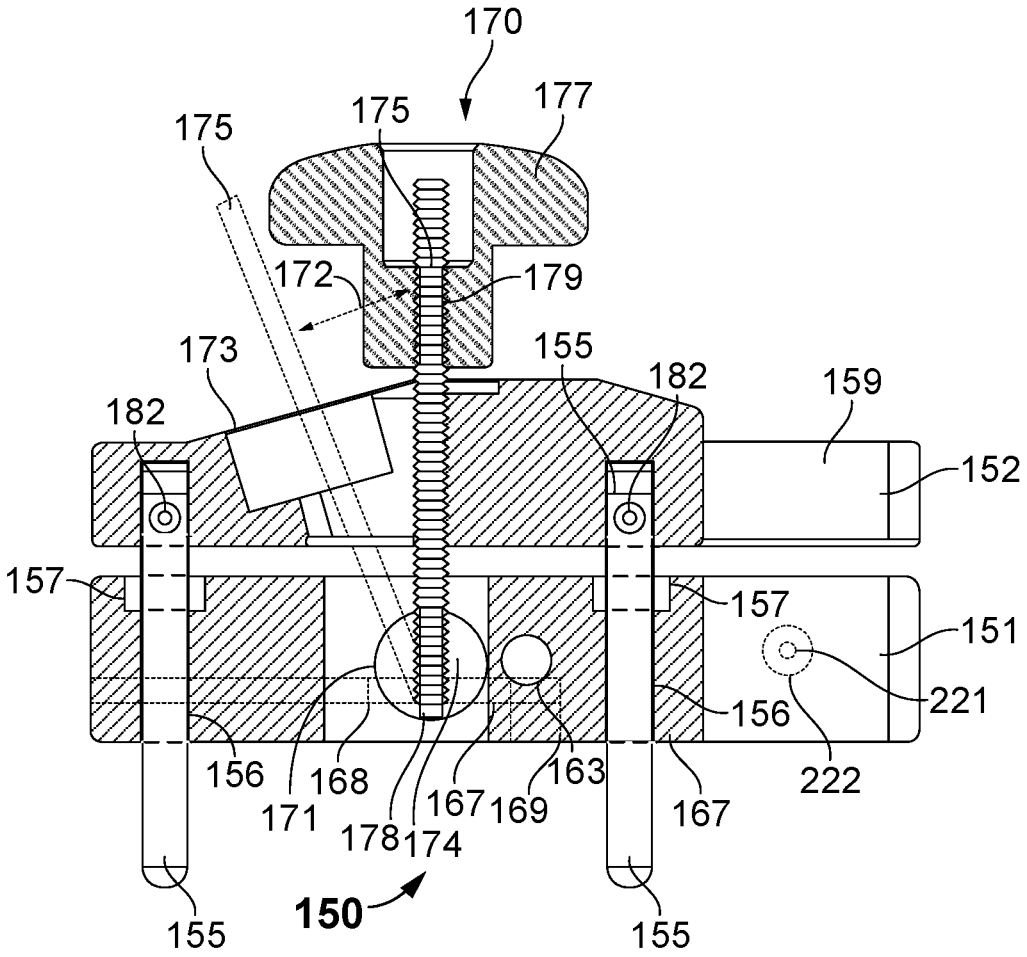
FIG. 11A is a cross-sectional view, taken along lines E-E of FIG. 5, illustrating a combined extension clamp and operating table rail clamp of the invention.
Figure 11B:
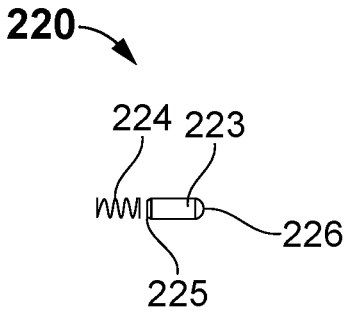
FIG. 11B illustrates an arm locking assembly.
Figure 12:
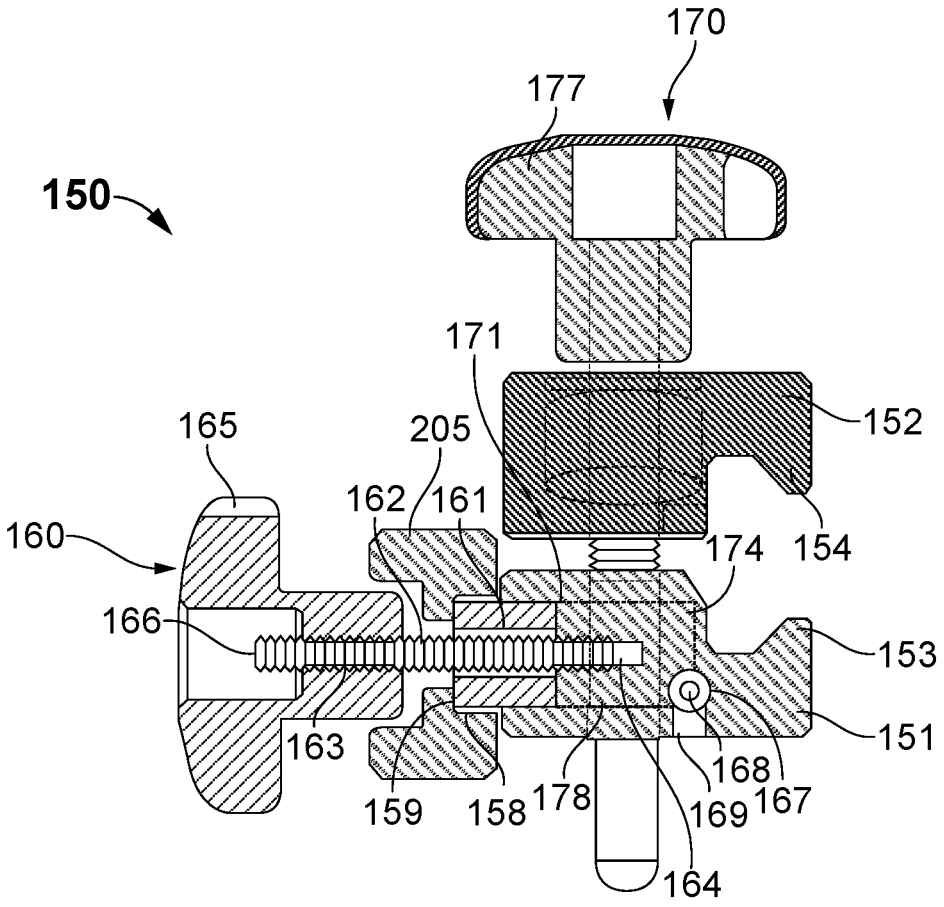
FIG. 12 is a cross-sectional view, taken along lines F-F of FIG. 5, illustrating a combined extension clamp and operating table rail clamp of the invention.

Referring to FIGS. 10-12 the arc lever clamp assembly 170 comprises a hinge aperture, hole or opening 171 that may be formed in the base clamp 151 and an opening allowing radial movement 172 with a sloped and/or arcuate surface 173 formed in the body portion of the top clamp 152. The hinge opening 171 receives a threaded insert 174 to receive a threaded rod or bar 175 that may be formed threaded along its length and to have a knob 177 with threads 179 to provide a clamping force; although, is to be appreciated that it may be partially threaded at the proximal and distal ends thereof. In operation, the clamp assembly 150 is positioned over the operating table 102 side rail 103 arranging the jaws 153, 154 of the base clamp 151 and top clamp 152 on opposite edges of the side rail 103, the rod 175 is rotated through the arc of the radial opening to the vertical position, and the knurled knob 177 is rotated in the clockwise (C) indicated direction to secure the jaws 153, 154 together.

The arc lever clamp 170 comprises the hinge opening 171 receiving a threaded insert 174 The rod 175 is configured with flattened end portion 178, at a distal end of the rod 175 relative to the knob 177, whereby the flattened end portion may be formed by milling to provide a positioning within the base clamp 151 to be set by a set screw to secure the distal end of the rod 175 so as to prevent from turning, thereby allowing the knob 177 to apply the clamping force. For ease of illustration, the same set screw 168 may be utilized to set the distal end 178 to keep from turning however, it should be appreciated that a separate set screw and hole may be utilized for the arc lever clamp 170. The knob 177 may be configured with an internal threads 179 to operably function to provide clamping force, e.g. one-hand turning of the knob 177 tightens and/or loosens along threads 176 of rod 175. In operation, 160 so that the rod 162 stays fixed while the knob 167 turns to provide a clamping force to the transverse arm 140, or to the mount assembly 200 in the side rail line 103*a* (FIG. 16), to the side rail 103 as desired. The components of the rod 175, knob 177, and set screws 165, 168 may be sterilized, as well as holes 161, 165 and 169 provide clear passages for sterilization of the base clamp 151.

The milled distal end 164 is configured flattened and positioned so the end portion 164 faces up so as to position and for clearance within the base clamp 151. A set screw hole 168 may be formed in the base clamp 151 and configured for securing a distal end of the rod 162 of the set clamp 160 so that the rod 162 stays fixed while the knob 167 turns to provide a clamping force to the transverse arm 140, or to the extension 180, to the side rail 103 as desired. The components of the arc lever clamp assembly including the base and top clamps 151, 152, the threaded insert 174, the rod 175, the knob 177, and set screw 182 may be sterilized, as well as sterilization and clearing of holes 171, 180, 182 and the radial opening 172 to provide clear passages for sterilization of the clamp assembly 150.

Referring to FIGS. 11B and 12, the clamp assembly 150 may be configured with an arm locking assembly 220 comprising a dimple 221 formed in an opposing surface of arm slot 159 of base clamp 151, button tab hole 222 (shown in phantom superimposed on arm slot 159 in FIG. 12) with an outer diameter greater than an insert 223 and spring 224 in base clamp 151 that extends into base clamp 151 from an inner surface of arm slot 159. The button tab hole 221 is configured to receive the spring 224 with a flat end 225 of the insert 223 against the spring 224 and an arcuate or button end 226 adapted to extend into the inner arm slot 159 and engage dimple 221 as well as the arm channel 142 of the transverse arm 140. In operation, the arm locking assembly 220 of the clamp assembly 130 and the positioner apparatus and system 100. The arm locking assembly 220 is adapted to displace inwardly as the transverse arm 140 is disposed or rotated into the arm slot 158 and to recoil or otherwise displace outwardly into the arm channel 142 from the bias of spring 224, thereby providing a positive seating or "clicking" of the arm in a vertical position adjacent side rail. Subsequently, the knob 166 of set clamp assembly 160 may be tightened to provide a clamping force to the bar 120 so as to hold and maintain the desired position of the base plate assembly 134 the patient undergoing the medical procedure 108. Turning knob 166 of the set clamp 160 base clamp 151 closes the arm slot 159 applying pressure from surfaces of the base and top clamp 151, 152 against transverse arm 140 and side rail 103.

The operation of the clamp assembly 150 and the knee positioner unit 100 is described according to an embodiment of positioning for a medical procedure 108 directed to knee surgery. To move the knee positioner unit 100 along the side rail 103 of the support or operating table 102, in the forward and reverse indicated directions, each of the knobs 166, 177 of the set clamp 160 and arc lever clamp 170, are rotated to the counterclockwise-indicated direction, which rotates along rods 162, 175 and unlocks the clamp assembly 150 from the operating table 102 side rail 103. When the plate assembly 130 is in the desired position, the operative knob 166, 177 is rotated to the clockwise-indicated position, to lock the clamp assembly 150 and the plate assembly 130 onto the operating table 102 side rail 103. For example, knob 177 is rotated from a $1^{st}$ position to a $2^{nd}$ vertical position and tightened to lock the arc clamp assembly 171 when the plate assembly 130 is at the desired location, then the transfers arm 140 is rotated into the arm slot 159 passing the arm locking assembly 220 and the knob 166 is rotated in the clockwise-indicated direction to lock transverse arm 140 in place. A simple operating table plate assembly 130 may be clamped to the operating table 102 one-hand operation of knobs 166, 177 for fastening and releasing operating table surgical support equipment has herein been described and, in conjunction with a mount extension 200, an operating table patient positioner unit, apparatus, system and method 100 may extend the plane of the operating table 102 plane a single to a $2^{nd}$ body size patient from a $1^{st}$ body size patient as herein described.

Referring to FIGS. 1-7, 9A-9B, and 13-15, a mount assembly 200 for extending and securing the patient positioner assembly and system 100 so as to hold the limb 104 and a holder 105 in the same plane of the operating table 102 and aligning with the side rail 103 in order to perform a predetermined medical procedure 108 from a $1^{st}$-sized body patient to a $2^{nd}$ sized body patient according to an embodiment of the present invention. The mount assembly 200 comprises a proximal beam 201 with a distal end 202 and a proximal end 203 relative to the end of the operating table 102, and an elongated, predetermined length 204, a slot end 205 formed on the proximal end 203. The slot end 205 of the mount assembly 200 is configured to receive the raised stop portion 158, to extend the side rail 103, and to operably connect the side rail 103 of the operating table using the clamp assembly 150. The mount assembly 200 is further configured with a distal beam 206 with a proximal end 207 and a distal end 208 relative to the end of the operating table 102, and an elongated predetermined length 209. The mount assembly 200 also is configured with an offset 210 disposed between the distal end 202 of the proximal beam 201 and the proximal end 207 of the distal beam 206. The offset 210 may be formed in a predetermined width dimension 211 so as to align with an edge 212 of the operating table 102 and extend plane of the operating table from the edge 212.

The mount assembly 200 is configured with a pair of support beams 240 and 241 for supporting the base plate assembly 130. The support beams 240, 241 may be configured with a plurality of studs 242, 243, 244, and 245 adapted to be received by the base plate assembly 130. Studs 242-245 may be of the general mushroom-cap shape, although it should be appreciated that the studs may be of any suitable shape. The support beams 240, 241 further may be configured with one or more posts 245, 246, 247, 248, and 249 adapted to be received by an alignment slot 230 disposed on one or more lateral edges 133 of the base plate assembly 130.

The mount assembly 200 is configured with a plate locking assembly 250 comprising a head cap 251, a threaded rod 252, a spring or other biasing member 253, a washer cap 254, and a threaded knob 255 that is utilized for aligning the studs 242-245 and the posts 246-249. The plate locking assembly 250 comprises a knob 177 at one end of the threaded rod 252 extending through a cavity of the distal beam 206 and a circular head cap 251 on the other side of the treaded rod 252 the distal beam 206 which may be biased by the spring 252 and washer cap 254 to improve setting the bed 131 and responsiveness of the clamping force of the plate locking assembly 250. The spring 253 urges the head cap 251 of the plate locking assembly 250 to provide spring-loading so as to allow deflection when inserting and/or removing the bed 131 and disengaging the respective studs 242, 243 or 244, 245 from a recess of the whole offset radius 265 of the base plate assembly 130.

The threaded knob 255 may be configured press the head cap 251 against a lateral edge 133 of the bed 131 of the base plate assembly 130 to seat the pair of studs 242, 243 or 244, 245 for right or left limbs, respectively, in a recess of the offset hole radius 265 formed in each extension mount opening 260, 261 of the base plate assembly 130 and to seat the respective pair of posts 246, 247 in the adjacent alignment slots 231, 232 or 232, 233 in the lateral edge 133 for right or left limbs, respectively. According to an embodiment of the invention, as illustrated in FIGS. 3-4, 6-7, 9A-9C and 13-16, the studs 242-245 are used in securing as, for example, each pair of right side studs 242, 243 or left side studs 244, 244 are disposed adjacent and received by the openings base plate, thereby extending the base plate a predetermined length dimension from an end of the patient support.

In addition, alignment is assured as each pair of right side posts 246, 247 or left side posts 248, 249 disposed adjacent each alignment slots 230 of the base plate 130 are utilized for alignment, e.g. right leg utilizes right and central orientation slots 231, 232 and left leg utilizes central and left orientation slots 232, 233, whereby the mount assembly 200 is flipped for either the right or left leg. The mount assembly 200 advantageously provides a co-planar surface for the base plate assembly 130 in the same plane with the support or operating table so as to accommodate a patient of a second body size greater than a first body size. The plurality of studs 242-245 may be disposed on a top and a bottom of a distal end of the support beams 240, 241 relative to the distal beam 206 so as to provide a universal mount extension 200 for right and left limbs in a medical procedure 108 so as to extend the side rail 103. The plurality of posts 246-249 also may be disposed on a top and a bottom of a proximal end of the support beams 240, 241 relative to the distal beam 206. Moreover, the slot end 205 may be formed in a predetermined length dimension adapted to define a stop point for the raised stop portion 158 of the set clamp 150 when receiving stop portion 158 on the base clamp 1212 extend the alignment and linear dimension of a side rail 103 of the operating table 102. The mount assembly 200 advantageously aligns with the side rail 103 and with a planar edge extending from operating table 102 coexistent with the bed 131. The mount assembly 200 further provides advantageously an inward step for both left and right limbs by extending the side rail 103 and planar edge of the operating table 102, whereby an actual extension of the operating table 102 places the base plate assembly 130 inboard with the track 138 (e.g. off-table) matching existing base plate assembly 130 positioning of the patient (e.g. on-table) so as to eliminate disadvantages of conventional systems that may shift the patient from being centered on the operating table 102, having an alignment shifted-over with the patient potentially hanging over an edge of the operating table 102 and/or otherwise not tracking the joint or bone properly.

While certain configurations of structures have been illustrated for the purposes of presenting the basic structures of the present invention, one of ordinary skill in the art will appreciate that other variations are possible which would still fall within the scope of the appended claims. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A patient positioning system comprising:

a base plate for securing to an operating table, said base plate adapted to be aligned with a plane of said operating table; said base plate having a track formed in an upper surface along a length thereof, said base plate is configured with one or more openings on a bottom surface, said one or more openings configured to receive a plurality of studs of a mount configured to operably connect said base plate and said mount to extend the base plate in the plane of the operating table;

a carriage comprising a guide portion configured to operatively connect to said track, said carriage supported on said base plate for selective movement along said track, said carriage adapted to receive a holder for a patient limb, said holder operatively connecting with said carriage for selectively locking in a desired position; and a clamp assembly for operably coupling said base plate to a side rail of the operating table; said clamp assembly configured with set clamp portion either for operably connecting to a transverse arm of said base plate disposed in arm slot to the side rail of the operating table or for operably connecting to an end slot of said mount and an arc lever clamp portion to close a base clamp and a top clamp to the side rail in the plane of the operating table.

2. The positioning system of claim 1 wherein said openings in said bottom surface having a recessed slot adapted to receive a plurality of studs of said mount for extending in the plane from the operating table.

3. The positioning system of claim 1 wherein said base plate is further configured with a post disposed on an edge of said base plate adapted to be received by an alignment slot of said mount.

4. The positioning system of claim 1 wherein said carriage is adapted to receive a ball of a post secured to said holder, said holder being generally an L-shaped member adapted to engage and support a lower leg and foot of a patient; said carriage supporting said holder to allow positioning of said human joint above said base plate.

5. The positioning system of claim 1 wherein said carriage is adapted to allow positioning of said base plate for selective movement there along in a plane extending from the operating table.

* * * * *